US007534090B2

(12) United States Patent
Good et al.

(10) Patent No.: US 7,534,090 B2
(45) Date of Patent: May 19, 2009

(54) ENHANCED BUCKET VIBRATION SYSTEM

(75) Inventors: Randall Richard Good, Simpsonville, SC (US); Benjamin Arnette Lagrange, Greer, SC (US); Gary Charles Liotta, Simpsonville, SC (US); James William Vehr, Travelers Rest, SC (US); Jonathan David Crim, Simpsonville, SC (US); Stephen Paul Wassynger, Simpsonville, SC (US); Anthony Aaron Chiurato, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 402 days.

(21) Appl. No.: 11/423,795

(22) Filed: Jun. 13, 2006

(65) Prior Publication Data

US 2007/0286732 A1 Dec. 13, 2007

(51) Int. Cl.
*F01D 5/26* (2006.01)

(52) U.S. Cl. ..... 416/193 A; 415/119

(58) Field of Classification Search ..... 415/119, 415/139; 416/190, 192, 193 A
See application file for complete search history.

(56) References Cited

U.S. PATENT DOCUMENTS

| | | | | |
|---|---|---|---|---|
| 4,872,812 | A * | 10/1989 | Hendley et al. | 416/190 |
| 4,936,749 | A * | 6/1990 | Arrao et al. | 416/193 A |
| 5,156,528 | A | 10/1992 | Bobo | |
| 5,281,097 | A | 1/1994 | Wilson et al. | |
| 5,478,207 | A | 12/1995 | Stec | |
| 6,354,803 | B1 | 3/2002 | Grover et al. | |
| 6,390,775 | B1 | 5/2002 | Paz | |
| 6,478,544 | B2 * | 11/2002 | Brandl et al. | 416/190 |
| 6,776,583 | B1 | 8/2004 | Wang et al. | |
| 6,851,932 | B2 | 2/2005 | Lagrange et al. | |
| 7,322,797 | B2 * | 1/2008 | Lee et al. | 416/193 A |

* cited by examiner

*Primary Examiner*—Edward Look
*Assistant Examiner*—Nathaniel Wiehe
(74) *Attorney, Agent, or Firm*—Sutherland Asbill & Brennan LLP

(57) ABSTRACT

An enhanced damping system for a turbine bucket. The damping system includes a damper pocket and a damper pin with an offset center of gravity positioned within the damper pocket.

16 Claims, 2 Drawing Sheets

ENHANCED BUCKET VIBRATION SYSTEM

TECHNICAL FIELD

The present application relates generally to gas turbines and more particularly relates to turbine buckets having a bucket damping system for minimizing bucket vibration.

BACKGROUND OF THE INVENTION

Gas turbines generally include a rotor with a number of circumferentially spaced buckets. The buckets generally include an airfoil, a platform, a shank, a dovetail, and other elements. The dovetail is positioned about the rotor and secured therein. The airfoils project into the gas path so as to convert the kinetic energy of the gas into rotational mechanical energy. During engine operation, vibrations may be introduced into the turbine buckets that can cause premature failure of the buckets if not adequately dissipated.

Many different forms of vibration dampers are known. One example is found in commonly owned U.S. Pat. No. 6,851,932, entitled "VIBRATION DAMPER ASSEMBLY FOR THE BUCKETS OF A TURBINE." The dampers shown therein may be used in the 6C-stage 2 bucket as is offered by General Electric Company of Schenectady, N.Y. The 6C-stage 2 bucket may experience relatively high vibratory stresses during, for example, transient operations.

Although these known dampers may be largely adequate during typical operation, known designs have locked up on occasion due to higher than expected frictional forces. Known designs also were believed to be binding on the sharp edges of the buckets due to functional intolerances with respect to manufacturing variances in the contact surfaces. As such, there is a desire to improve overall damper effectiveness, provide tolerance of radial misalignment of adjacent bucket contact surfaces, provide a low susceptibility to friction lock up, ensure proper bucket contact, prohibit rotation of the damper during startups and shutdowns, and ensure proper installation of the damper. These goals preferably may be accommodated and achieved without loss of overall system efficiency.

SUMMARY OF THE INVENTION

The present application thus describes a damping system for a turbine bucket. The damping system includes a damper pocket and a damper pin with an offset center of gravity positioned within the damper pocket.

The bucket includes a convex side and the damper pocket is positioned on the convex side. The bucket also includes a concave side with an undercut. The undercut may include an angled surface. The damper pin contacts both the damper pocket and the undercut when under centrifugal force.

The damper pin may include a leading boss and a trailing boss. The leading boss may include a contact prong and a rounded crown. The trailing boss may include a boss angled surface and a protrusion. The damper pocket may include a pocket angled surface positioned about the boss angled surface.

The present application further describes a damping system for a turbine bucket. The damping system includes a damper pocket and a damper pin positioned within the damper pocket. The damper pin includes a leading boss with a rounded crown and a trailing boss.

The damper pin may include an offset center of gravity. The bucket includes a convex side with the damper pocket positioned thereon. The bucket also includes a concave side with an undercut. The undercut may include an angled surface. The damper pin contacts both the damper pocket and the undercut when under centrifugal force. The trailing boss may include a boss angled surface and a protrusion. The damper pocket may include a pocket angled surface positioned about the boss angled surface. The damper pin may include a flat surface and a rounded surface.

These and other features of the present application will become apparent to one of ordinary skill in the art upon review of the following detailed description when taken in conjunction with the drawings and the appended claims.

DETAILED DESCRIPTION

Figure 1:
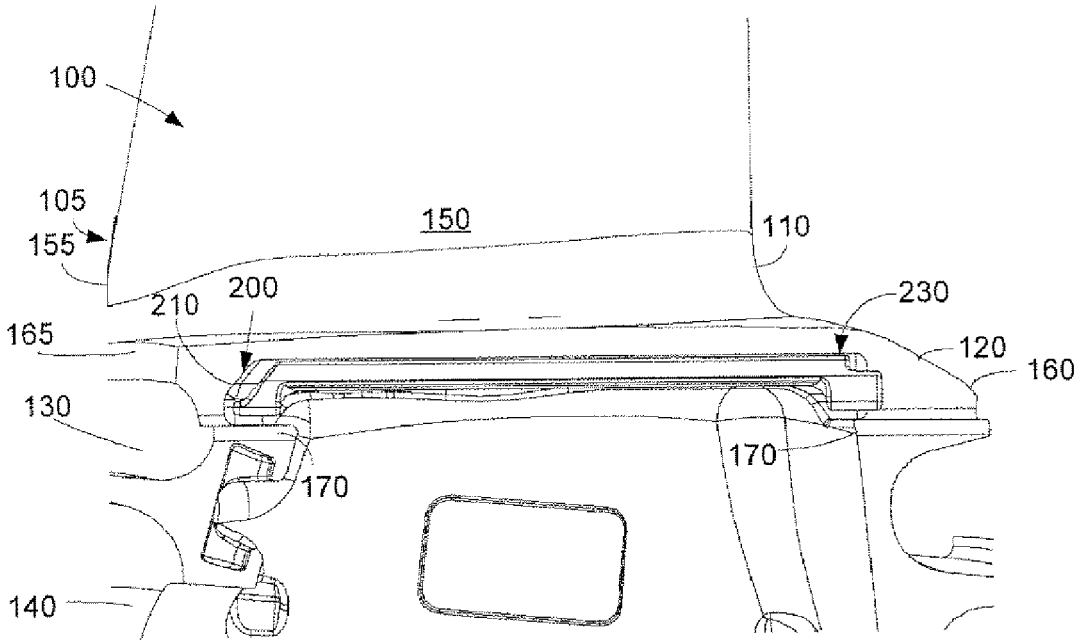
FIG. 1 is a perspective view of the bucket vibration damping system as is described herein.

Referring now to the drawings, in which like numerals refer to like elements throughout the several views, FIG. 1 illustrates a bucket damping system 100 as is described herein. The bucket damping system 100 includes a number of buckets 105. The buckets 105 may include a bucket airfoil 110, a platform 120, a shank 130, a dovetail 140, and other elements. It will be appreciated that the bucket 105 shown is one of a number of circumferentially spaced buckets 105 secured to and about the rotor of a turbine. As described above, turbines generally have a number of rotor wheels having axial or slightly off axis dovetail-shaped openings for receiving the dovetail 140 of the bucket 105. Likewise, the airfoils 110 project into the gas stream so as to enable the kinetic energy of the stream to be converted into mechanical energy through the rotation of the rotor.

The airfoil 110 includes a convex side 150 and a concave side 155. Likewise, the airfoil platform 120 includes a leading edge 160 and a trailing edge 165 extending between the convex side 150 and the concave side 155. A pair of generally axially spaced support ledges 170 may be positioned on the convex side 150 of the bucket 105. Likewise, an undercut 180 may be positioned within the bucket platform 120 from the leading edge 160 to the trailing edge 165 along the convex side 150 on the other end. The undercut 180 includes an angled surface 190 that may extend the full axial length of the bucket 105.

Figure 2:
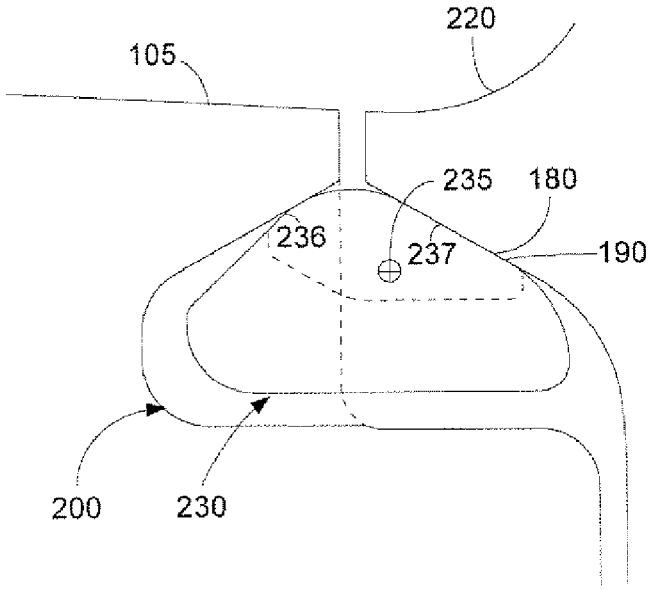
FIG. 2 is a side cross-sectional view of the damping pin as used in the bucket vibration damping system of FIG. 1.

FIG. 1 also shows a damper pocket 200 as is described herein. The damper pocket 200 may be positioned just above the support ledges 170 on the convex side 150. The damper pocket 200 may have any convenient size and shape so as to accommodate the bucket 105 as a whole. The pocket 200 also may have an angled surface 210 on one end. The angled surface 210 ensures proper installation of a damper pin as will be described in more detail below. FIG. 2 shows the use of the bucket 105 with an adjoining bucket 220 such that the undercut 180 of the adjoining bucket 220 completes the damper pocket 200. The damper pocket 200 may be machined or cast within the platform 120. Other types of manufacturing techniques may be used herein.

Figure 3:
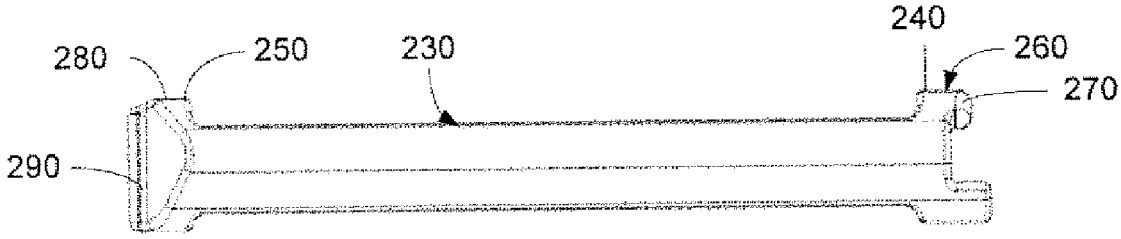
FIG. 3 is a top plan view of a damper pin for use with the bucket vibration damping system of FIG. 1.

Positioned within the damper pocket 200 may be a damper pin 230. As is shown in FIGS. 2 and 3, the damper pin 230 may be an elongated, generally triangular shaped element. As is shown in FIG. 2, the damper pin 230 may have an offset center of gravity 235 with a rounded surface 236 on one side and a flat surface 237 on the other. The offset center of gravity 235 assists in maintaining face to face contact of the flat surface 237 with the angled surface 190 of the undercut 180 on one side and line contact of the rounded surface 236 with the upper surface of the damper pocket 200 on the other side.

The damper pin 230 also has a pair of axially spaced bosses 240, 250 on either end. The leading boss 240 may include a contact prong 260. The contact prong 260 includes a rounded crown 270 on one side thereof. Other shapes may be used herein. The use of the contact prong 260 prevents the damper 230 from sliding forward due to centrifugal force. The rounded crown 270 prevents any sharp edged snags and allows free sliding in the radial direction. The trailing end boss 250 may include an angled surface 280 with a short protrusion 290. The angled surface 280 comports with the angled surface 210 of the damper pocket 200 so as to ensure proper installation of the damper pin 230.

The damper pin 230 may have some play or space within the damper pocket 200 and the undercut 180. As described above, the damper pin 230 will engage the upper surface of the damper pocket 200 and the undercut 180 via centrifugal force such that both buckets 105, 220 are engaged once the buckets 105, 220 are at full speed. This contact is aided by the offset center of gravity 235. The frictional force between the damper pin 230 and the buckets 105, 220 thus dissipates the vibrational energy from the buckets 105, 220. Because the contact between the damper pin 230 and the buckets 105, 220 are at an incline from the trailing edge 165 to the leading edge 160, the damper pin 230 has a tendency to slide forward. The contact prong 260 of the leading boss 240 therefore restrains the damper pin 230 in its proper axial position.

The damper pocket 200 thus radially and axially restrains the damper pin 230 in its proper position. Likewise, the support ledges 170 support the damper pin 230 when the bucket 105 is not rotating and under centrifugal force. The angled surface 210 of the damper pocket 200 also ensures proper installation of the damper pin 230 when taken in conjunction with the angled surface 280 of the damper pin 230. The bucket damping system 100 thus provides improved damping effectiveness, minimizes the chances of lockup due to frictional forces, avoids interference with adjacent buckets, and prohibits rotation of the damper pin 230 during startups and shutdowns.

It should be readily apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A damping system for a turbine bucket, comprising:

a damper pocket; and a damper pin positioned within the damper pocket;

wherein the damper pin comprises a longitudinal axis, an offset center of gravity, a leading boss, and a trailing boss; and wherein the trailing boss comprises a boss angled surface transverse to the longitudinal axis and wherein the damper pocket comprises a pocket angled surface positioned about the boss angled surface.

2. The damping system of claim 1, wherein the bucket comprises a convex side and wherein the damper pocket is positioned on the convex side.

3. The damping pocket of claim 1, wherein the bucket comprises a concave side and wherein the bucket comprises an undercut on the concave side.

4. The damping system of claim 3, wherein the undercut comprises an angled surface.

5. The damping system of claim 3, wherein the damper pin contacts both the damper pocket and the undercut when under centrifugal force.

6. The damping system of claim 1, wherein the leading boss comprises a contact prong.

7. The damping system of claim 1, wherein the leading boss comprises a rounded crown.

8. The damping system of claim 1, wherein the trailing boss comprises a protrusion.

9. A damping system for a turbine bucket, comprising:

a damper pocket; and a damper pin positioned within the damper pocket;

wherein the damper pin comprises a longitudinal axis, a leading boss and a trailing boss and wherein the leading boss comprises a rounded crown and wherein the trailing boss comprises a boss angled surface transverse to the longitudinal axis; and wherein the damper pocket comprises a pocket angled surface positioned about the boss angled surface.

10. The damping system of claim 9, wherein the damper pin comprises an offset center of gravity.

11. The damping system of claim 9, wherein the bucket comprises a convex side and wherein the damper pocket is positioned on the convex side.

12. The damping pocket of claim 9, wherein the bucket comprises a concave side and wherein the bucket comprises an undercut on the concave side.

13. The damping system of claim 12, wherein the undercut comprises an angled surface.

14. The damping system of claim 12, wherein the damper pin contacts both the damper pocket and the undercut when under centrifugal force.

15. The damping system of claim 9, wherein the trailing boss comprises a protrusion.

16. The damping system of claim 9, wherein the damper pin comprises a flat contact surface and a rounded contact surface.

* * * * *